United States Patent [19]

Morris et al.

[11] Patent Number: 4,740,768

[45] Date of Patent: Apr. 26, 1988

[54] MANUAL TRIP OPERATOR FOR MOLDED CASE CIRCUIT BREAKER

[75] Inventors: Robert A. Morris, Burlington; Roger N. Castonguay, Terryville; Joseph M. Palmieri, Southington, all of Conn.

[73] Assignee: General Electric Company, New York, N.Y.

[21] Appl. No.: 67,744

[22] Filed: Jun. 29, 1987

[51] Int. Cl.[4] ..... H01H 73/48; H01H 75/00; H01H 77/00; H01H 83/00

[52] U.S. Cl. ..... 335/22; 335/26; 335/14

[58] Field of Search ..... 335/9, 13, 14, 17, 26, 335/22, 38, 176, 21

[56] References Cited

U.S. PATENT DOCUMENTS

| | | | |
|---|---|---|---|
| 3,214,537 | 10/1965 | Krieger | 335/22 |
| 3,671,890 | 6/1972 | Klein et al. | 335/22 |
| 4,529,951 | 7/1985 | Youichi et al. | 335/22 |

*Primary Examiner*—E. A. Goldberg
*Assistant Examiner*—Lincoln Donovan
*Attorney, Agent, or Firm*—Richard A. Menelly; Walter C. Bernkopf; Fred Jacob

[57] ABSTRACT

A manually operated trip operator is inserted within a recess formed in a molded case circuit breaker cover, and extends down within the breaker case to interact with the circuit breaker trip bar. The trip operator is formed from a unitary thermoplastic configuration which integrally includes means for interacting with the circuit breaker trip bar and for biasing the trip operator back to its initial position. The unitary manual trip operator is down-loaded into the circuit breaker cover in an automated circuit breaker assembly process.

6 Claims, 4 Drawing Sheets

MANUAL TRIP OPERATOR FOR MOLDED CASE CIRCUIT BREAKER

BACKGROUND OF THE INVENTION

U.S. patent application Ser. No. 061,244, filed June 12, 1987 entitled "Molded Case Circuit Breaker Accessory Enclosure" describes a circuit breaker and accessory which are mainly assembled together in an automated manufacturing process. The circuit breaker rating plug and the accessory units are down-loaded within recesses formed in the circuit breaker cover with little or no manual intervention. A manually accessible trip button or operator is generally provided on the top surface of a circuit breaker cover to allow the operator to trip the circuit breaker operating mechanism in order to determine whether the circuit breaker mechanism is functional. There are several existing trip button designs that rely upon the depression of the trip button or the rotation thereof to effect internal contact with the circuit breaker operating mechanism.

One example of a two-piece circuit breaker trip button is found in U.S. Pat. No. 3,671,890 entitled "Manually Operable Molded Case Circuit Breaker With Special Trip Testing Means". The trip button described therein is formed from two separate injection molded plastic pieces. The top piece consists of an externally accessible cylindrical trip button positioned within a recess formed in the circuit breaker cover above a separate angled bottom piece wherein one of the angle legs interacts with the circuit breaker trip bar while the other angle leg resiliently interacts with a stop on the circuit breaker cover to return the trip button top piece to its original position. This patent is incorporated herein for purposes of reference and should be reviewed for its teaching of the interaction of a manually operable trip button with a circuit breaker trip bar and operating mechanism.

However, the manually operable trip button disclosed within the aforementioned U.S. Patent does not readily lend itself to an automatic assembly process. The angled bottom piece is first positioned within the circuit breaker case with the circuit breaker cover removed. The cylindrical top piece is later assembled within the circuit breaker cover and requires some precise alignment to insure a proper connection between the two pieces.

Accordingly, the purpose of the instant invention is to provide a one-piece manually operable trip operator that can be down-loaded within the circuit breaker cover in a single automated assembly process.

SUMMARY OF THE INVENTION

A unitary thermoplastic manual trip operator is down-loaded within a recess formed in a circuit breaker cover. The trip operator includes both a trip initiating tab and a spring-like lever projecting from a base member which connects with a digital access cap. The digital access cap is supported within a recess formed within the circuit breaker cover while the tab and spring-like lever pass through an access slot formed in the bottom of the cover recess for interacting with the circuit breaker trip bar.

DESCRIPTION OF THE PREFERRED EMBODIMENT

Figure 1:
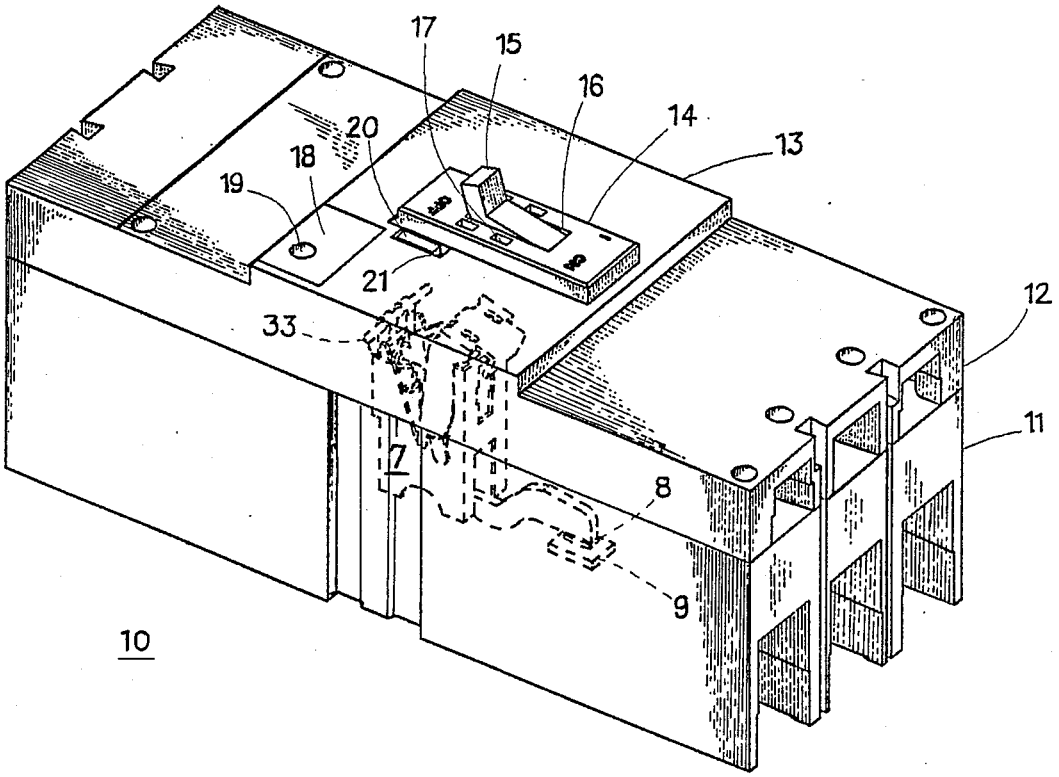
FIG. 1 is a top perspective view of a molded case circuit breaker employing the manual trip operator according to the invention.

A molded case circuit breaker 10 is shown in FIG. 1 to consist of a case 11 to which a cover 12 is fastened and which includes a raised central portion or inner surface 13 integrally formed with the cover during the injection molding process. An escutcheon 14 is formed on the inner surface and includes a handle operator 15 which projects through a handle access slot 16 formed in the escutcheon. Also formed within the escutcheon on both sides of the handle operator are two pairs of indicating windows 17 for indicating the status of the circuit breaker contacts 8, 9 contained within the circuit breaker case and controlled by an operating mechanism generally indicated at 7. A good description of the indicating windows 17 is found within U.S. patent application Ser. No. 060,516, filed June 11, 1987 entitled "Molded Case Circuit Breaker With Contact Status Indicating Handle", which Application is incorporated herein for purposes of reference. Also shown on the inner surface 13 is a rating plug 18 which includes a test jack access opening 19. A good description of the rating plug is found within U.S. patent application Ser. No. 045,645 entitled "Rating Plug Enclosure for Molded Case Circuit Breaker", which Application is also incorporated herein for purposes of reference. The manual trip operator 20 sits within a trip operator support recess 21 formed on one side of the escutcheon 14. The trip operator is arranged for transverse motion within the slot to interact with the circuit breaker trip bar 33 to thereby articulate the circuit breaker operating mechanism 7 for separating the circuit breaker contacts 8, 9.

Figure 2:
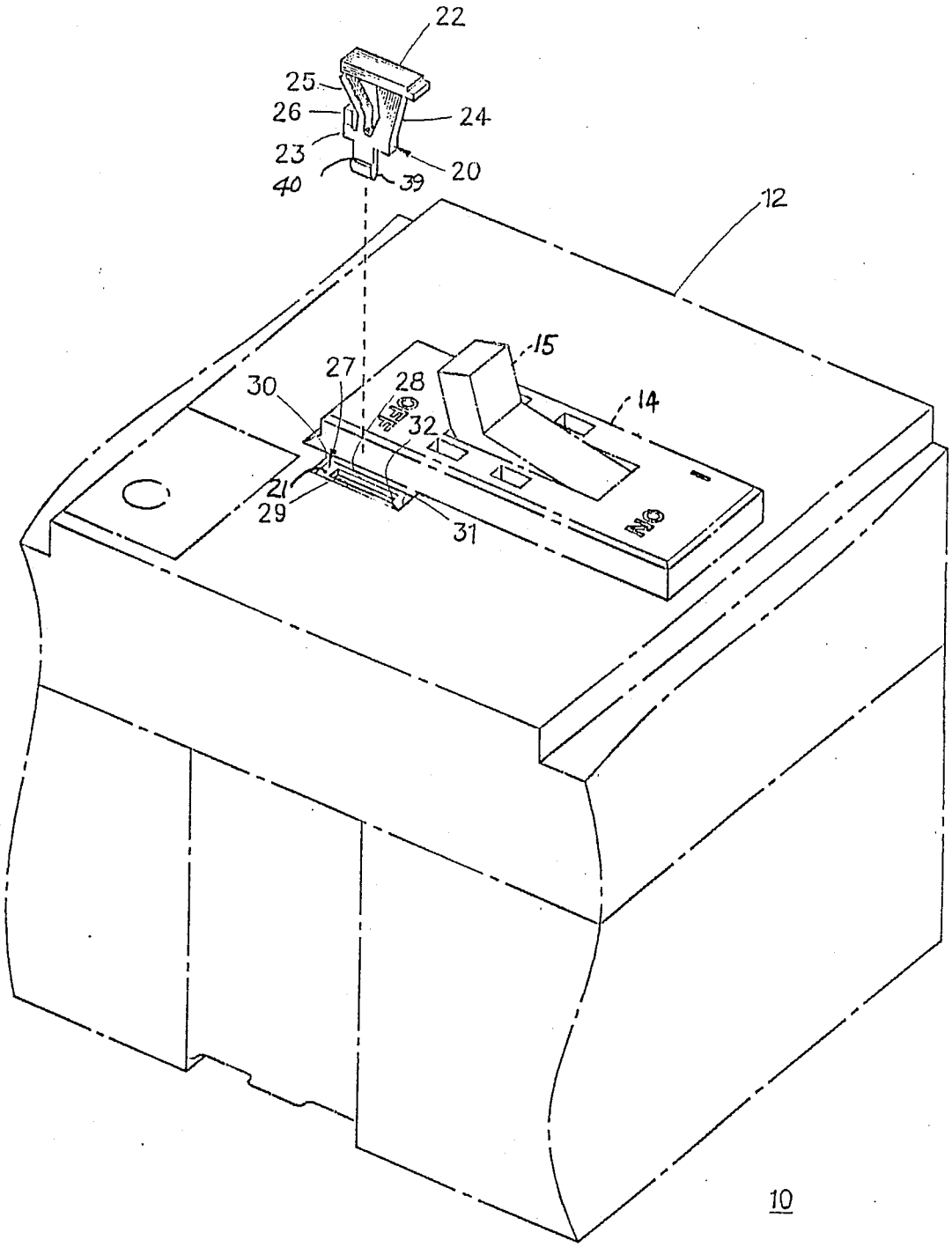
FIG. 2 is a top perspective view in isometric projection of the manual trip operator of the invention prior to assembling within the circuit breaker depicted in FIG. 1.

The assembly of the trip operator 20 in a downloaded operation can be seen by referring now to the circuit breaker 10 shown in FIG. 2. The operator consists of a single thermoplastic structure which includes a base 23 from which a support post 24 connects with a rectangular digital access cap 22 along with a tab 26 and a lever 25 and which includes a hook 40 formed in the bottom 39. The tab 26 interacts with the circuit breaker trip bar 33 shown earlier in FIG. 1 and will be discussed in detail with reference to FIGS. 3A, 3B and 4. The lever 25 cantilevers upwards from the base 23 and acts as a return spring for the operator 20 as will be discussed below in some detail. The trip operator support recess 21 is formed within the circuit breaker cover 12 next to the operating handle 15 and escutcheon 14 and includes a front and rear wall 30, 31 joined by a pair of opposing side walls 28 and 29. The bottom 27 of the trip operator support recess 21 supports the rectangular cap 22 while the remainder of the trip operator 20 passes through the trip operator access slot 32 formed through the bottom 27 of the trip operator support recess 21. The side walls 28, 29 slidingly guide the rectangular cap 22 when moved within the trip operator support recess 21 while the front and rear walls 30, 31 provide stopping surfaces for the rectangular cap 22.

Figure 3A:
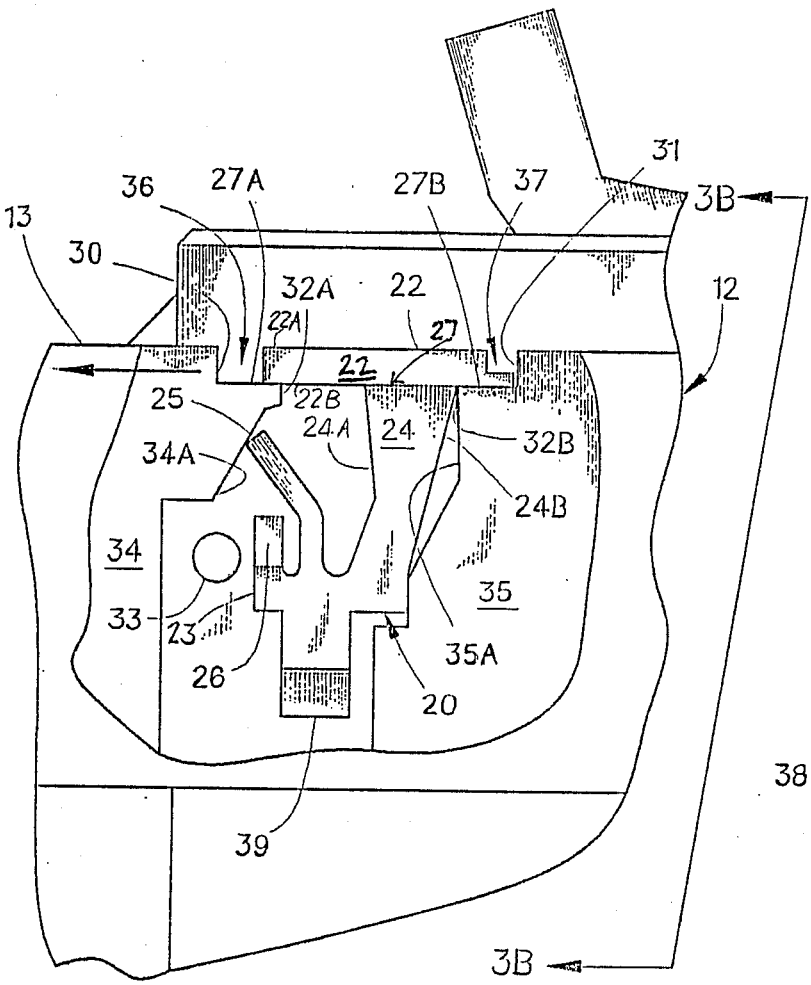
FIG. 3A is an enlarged side view of a part of the circuit breaker depicted in FIG. 1 prior to contact of the trip operator with the circuit breaker trip bar.
Figure 3B:
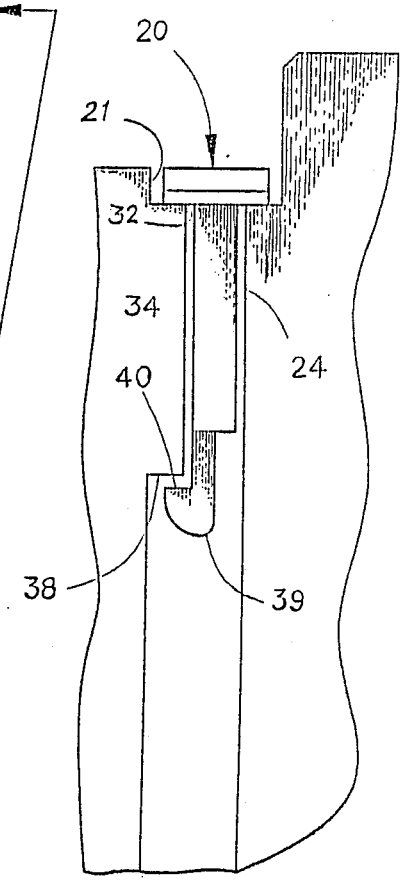
FIG. 3B is an end view in partial section of the side view depicted in FIG. 3A.
Figure 4:
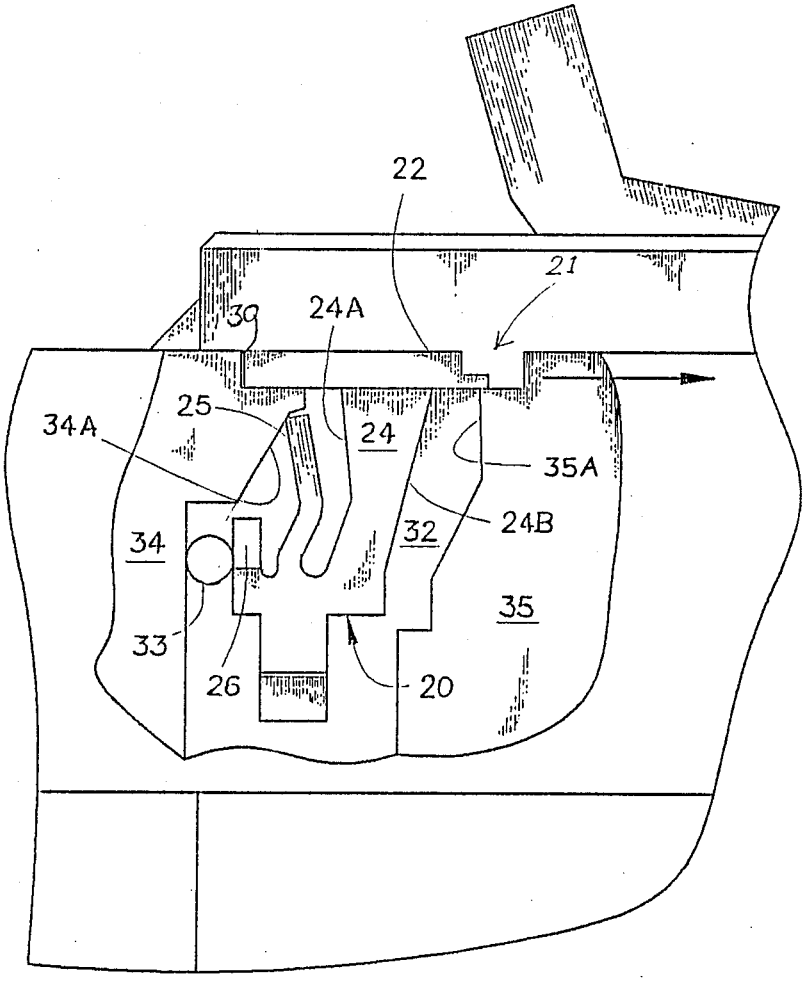
FIG. 4 is an enlarged side view of a part of the circuit breaker depicted in FIG. 1 during contact of the trip operator with the circuit breaker trip bar.

Referring now to FIGS. 3A, 3B and 4, the trip operator 20 is depicted in its "untripped" position in FIG. 3A within both the trip operator support recess 21 (FIG. 3B) defined by front and rear walls 30, 31 as well as within the trip operator access slot 32 defined by front and rear walls 32A, 32B as indicated in FIG. 3A. The top 22A of the rectangular cap 22 is flush with the inner surface 13 and the bottom 22B is supported by the bottom 27 of the support recess which includes a front part 27A and a rear part 27B. The access slot is defined between two walls 34, 35 formed integrally with the circuit breaker cover 12 and which present wall surfaces 34A, 35A as indicated. For purposes of illustration, as well as to define the direction of motion of the trip operator 20 within the circuit breaker cover 12, the trip operator post 24 is defined as presenting a front edge 24A and a rear edge 24B. In the untripped position depicted in FIG. 3A, a front gap 36 is defined between the front edge of the rectangular cap 22 and the front wall 30 of the support recess while a rear gap 37 is defined between the rear edge of the rectangular cap 22 and the rear wall 31 of the support recess. In this position, lever 25 extending in cantilever fashion from the base 23 lightly contacts the surface 34A of the internal wall 34 and the tab 26 is out of contact with the circuit breaker trip bar 33. To prevent the trip operator 20 from being removed from the circuit breaker cover 12, the bottom 39 of post 24 has a hook-shaped part 40 which catches under an overhang 38 formed in the circuit breaker cover as best seen in FIG. 3B. To manually trip the circuit breaker operating mechanism, a screw driver or similar tool (not shown) is inserted within the rear gap 37 and is rotated in either a clockwise or counterclockwise direction thereby urging the rectangular cap 22 and hence the entire trip operator 20 into the trip position shown in FIG. 4. The tab 26 strikes the trip bar 33 moving it into the position indicated in FIG. 4 thereby articulating the circuit breaker operating mechanism to open the circuit breaker contacts. The lever 25 strikes against the surface 34A of the internal front wall 34 causing the lever to flex and to bias the trip operator 20 driving it back to the initial position shown in FIG. 3A. The front edge of the rectangular cap 22 stops against the front wall 30 of the support recess 21 during the tripping operation to prevent damage to the tab 26 and lever 25. When the trip operator is driven back to the initial position shown in FIG. 3A, the rear surface 24B of post 24 stops against the rear edge 32B of the access slot thereby locating the trip operator to its initial or "untripped" position.

The positioning of the trip operator 20 between the front and rear walls 30, 31 of the support recess and between the two surfaces 34A, 35A of the integrally formed walls 34, 35, within the circuit breaker cover 12 are important features of the instant invention. This arrangement allows for the controlled motion of the trip operator within the cover without requiring any additional springs and stops. The dimensioning of the front and rear gaps 36, 37 on the ends of the rectangular cap 22 prevents inadvertent movement of the trip operator 20 since some tool is required to reach within the rear gap 37 to provide impelling motion to the trip operator via the rectangular cap 22.

Having thus described my invention, what I claim as new and desire to secure by Letters Patent is:

1. A molded case circuit breaker having manual test means comprising:

a molded plastic cover attached to a molded plastic case;

a circuit breaker operating mechanism within said case;

a pair of separable contacts arranged next to said operating mechanism;

a trip bar arranged next to said operating mechanism for articulating said operating mechanism and thereby separating said contacts;

a support recess formed in said cover and having a front wall and a rear wall joined by a bottom;

an access slot formed in said bottom and defined by a front wall and a rear wall; and a trip operator comprising a post terminating in a cap at one end thereof and a base at an opposite end thereof, said base further including a flexible lever and a tab extending from said base, said cap being supported within said support recess, said post extending through said access slot with said tab arranged next to said trip bar for articulating said operating mechanism when said cap is moved in a first direction within said support recess;

whereby said flexible lever extends in a cantilever fashion from said base and is arranged next to said front wall of said access slot, said flexible lever contacting said front wall of said access slot when said tab contacts said trip bar, said flexible lever then becoming flexed against said front wall of said access slot to propel said tab away from said trip bar thereby moving said cap in a second direction within said support recess, opposite said first direction.

2. The trip operator of claim 1 wherein a rear surface on said post stops against said rear wall of said access slot when said operator is propelled away from said trip bar.

3. The trip operator of claim 1 wherein said cap, post, base, tab and lever are integrally formed in a one-piece construction.

4. The trip operator of claim 3 wherein said one-piece construction comprises plastic.

5. The molded case circuit breaker of claim 1 further including a hook-shaped extension on said base to prevent removal of said trip operator from said molded plastic cover.

6. The molded case circuit breaker of claim 5 including a recess formed within said molded plastic cover receiving said hook-shaped extension to retain said trip operator within said plastic cover.

* * * * *